US006605405B2

(12) United States Patent
Owaki et al.

(10) Patent No.: US 6,605,405 B2
(45) Date of Patent: Aug. 12, 2003

(54) ELECTROPHOTOGRAPHIC METHOD AND ELECTROPHOTOGRAPHIC APPARATUS

(75) Inventors: Hironori Owaki, Shizuoka (JP); Toshiyuki Ehara, Kanagawa (JP); Yuji Nakayama, Chiba (JP); Masaya Kawada, Shizuoka (JP); Takaaki Kaya, Shizuoka (JP); Tetsuya Karaki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/911,611

(22) Filed: Jul. 25, 2001

(65) Prior Publication Data

US 2002/0051920 A1 May 2, 2002

(30) Foreign Application Priority Data

Jul. 26, 2000 (JP) ..... 2000-225121

(51) Int. Cl.[7] ..... G03G 13/02; G03G 13/04
(52) U.S. Cl. ..... 430/126; 399/220
(58) Field of Search ..... 430/126; 399/220

(56) References Cited

U.S. PATENT DOCUMENTS

| | | | | |
|---|---|---|---|---|
| 4,409,311 | A | 10/1983 | Kawamura et al. | 430/95 |
| 4,607,936 | A | 8/1986 | Miyakawa et al. | 355/3 DR |
| 4,659,639 | A | 4/1987 | Mizuno et al. | 430/65 |
| 4,788,120 | A | 11/1988 | Shirai et al. | 430/66 |
| 5,087,542 | A | 2/1992 | Yamazaki et al. | 430/60 |
| 5,392,098 | A | 2/1995 | Ehara et al. | 355/219 |
| 5,480,750 | A | 1/1996 | Kawada et al. | 430/31 |
| 5,561,024 | A | 10/1996 | Fukuda et al. | 430/128 |
| 5,576,060 | A | 11/1996 | Hirai et al. | 427/255.2 |
| 5,585,149 | A | 12/1996 | Hirai et al. | 427/578 |
| 5,640,663 | A | 6/1997 | Hirai et al. | 399/350 |
| 5,658,703 | A | 8/1997 | Hirai et al. | 430/95 |
| 6,233,417 | B1 * | 5/2001 | Nakayama et al. | 430/56 |

FOREIGN PATENT DOCUMENTS

| | | |
|---|---|---|
| JP | 56-83746 | 7/1981 |
| JP | 57-115556 | 7/1982 |
| JP | 57-158650 | 9/1982 |
| JP | 58 28752 | 2/1983 |
| JP | 58-102970 | 6/1983 |
| JP | 60-67951 | 4/1985 |
| JP | 60 95551 | 5/1985 |
| JP | 60 168187 | 8/1985 |
| JP | 62 168161 | 7/1987 |

* cited by examiner

*Primary Examiner*—John Goodrow
(74) *Attorney, Agent, or Firm*—Fitzpatrick, Cella, Harper & Scinto

(57) ABSTRACT

Provided are an electrophotographic method and an electrophotographic apparatus that can reduce ghost memory latent in an a-Si photosensitive member, relieve potential unevenness, and provide image copies with high quality. In an electrophotographic process of forming a toner image at least through decharging of a photosensitive member as a recording element, charging, exposing, developing, and transferring, at least a light-receiving layer of the photosensitive member is comprised of an amorphous material; a latent image is formed by the exposing with a light; the light has such a peak wavelength in an emission spectrum as to make minimum a value of optical memory at a unit contrast potential; and the decharging is implemented by use of a light having a full width at half maximum of a peak in an emission spectrum of not more than 50 nm.

16 Claims, 11 Drawing Sheets

ELECTROPHOTOGRAPHIC METHOD AND ELECTROPHOTOGRAPHIC APPARATUS

BACKGROUND OF THE INVENTION

1. Field of the Invention

The present invention relates to an electrophotographic method and an electrophotographic apparatus each using a charging unit of a corona discharge type. More particularly, the invention relates to an electrophotographic method and an electrophotographic apparatus each using an amorphous silicon based photosensitive member (hereinafter referred to as an a-Si photosensitive member) and, especially, to an electrophotographic method and an electrophotographic apparatus each capable of reducing ghost memory latent in the a-Si photosensitive member and relieving potential unevenness thereon, thereby providing image copies with high quality.

2. Related Background Art

In electrophotography, photoconductive materials making a photosensitive layer in the photosensitive member are required to have such characteristics as high sensitivity, high SN ratios [photocurrent (Ip)/dark current (Id)], possession of an absorption spectrum fit for spectral characteristics of radiated electromagnetic waves, quick optical response, possession of a desired dark resistance, being harmless to human bodies during use, and so on. Particularly, in the case of the photosensitive members for image forming apparatus built in the image forming apparatus used as business machines at offices, the nonpolluting property during the aforementioned use is a significant point. Hydrogenated amorphous silicon (hereinafter referred to as "a-Si:H") is a photoconductive material exhibiting an excellent property in this respect and, for example, Japanese Patent Publication No. 60-35059 describes application thereof to the photosensitive member for image forming apparatus.

The photosensitive members for image forming apparatus using a-Si:H are normally constructed by heating an electroconductive support at 50° C. to 400° C. and forming a photoconductive layer of a-Si on the support by a film forming method such as a sputtering method, an ion plating method, a thermal CVD method, a photo-CVD method, a plasma CVD method, or the like. Among these the plasma CVD method, which is a method of decomposing source gas by dc or high frequency or microwave glow discharge to form an a-Si deposited film on the support, is used as a preferred method in practice.

Japanese Patent Application Laid-Open No. 56-83746 suggests the photosensitive member for image forming apparatus consisting of an electroconductive support and a photoconductive layer of a-Si containing halogen as a constitutive element (hereinafter referred to as "a-Si:X"). This Application describes that when a-Si contains 1 to 40 atomic % of halogen, it becomes feasible to provide the photoconductive layer of the photosensitive member for image forming apparatus with high heat resistance and good electrical and optical characteristics.

Japanese Patent Application Laid-Open No. 57-115556 describes the following technology for improvement in the electrical, optical, and photoconductive characteristics such as dark resistance, photosensitivity, optical response, etc. of the photoconductive member having the photoconductive layer made of the a-Si deposited film, in the operating environment characteristics such as humidity resistance or the like of the photoconductive member, and in stability with a lapse of time; a surface layer made of a nonphotoconductive amorphous material containing silicon and carbon is laid on the photoconductive layer made of an amorphous material comprising silicon as a matrix.

Further, Japanese Patent Application Laid-Open No. 60-67951 describes the technology about the photosensitive member comprising a deposited film of a transparent insulating overcoat layer containing amorphous silicon, carbon, oxygen, and fluorine, and Japanese Patent Application Laid-Open No. 62-168161 describes the technology using an amorphous material containing constitutive elements of silicon, carbon, and 41 to 70 atomic % of hydrogen, as a surface layer.

Further, Japanese Patent Application Laid-Open No. 57-158650 describes that the photosensitive member for image forming apparatus with high sensitivity and high resistance is made by applying to the photoconductive layer a-Si:H containing 10 to 40 atomic % of hydrogen and having a ratio of absorption coefficients of absorption peaks at 2100 $cm^{-1}$ and at 2000 $cm^{-1}$ in an infrared absorption spectrum in the range of 0.2 to 1.7.

On the other hand, Japanese Patent Application Laid-Open No. 60-95551 discloses the technology for improvement in the image quality of the a-Si photosensitive member, in which the image forming steps including charging, exposure, development, and transfer are carried out while the temperature near the surface of the photosensitive member is maintained at 30 to 40° C., thereby preventing decrease of surface resistance due to adsorption of water on the surface of the photosensitive member and, in turn, preventing image run caused thereby.

These technologies improved the electrical, optical, and photoconductive characteristics and the operating environment characteristics of the photosensitive members for image forming apparatus and also improved the image quality in conjunction therewith.

With tendencies toward multiple utility of the electrophotographic apparatus and toward space saving at the offices and the like, there have been increasing desires for apparatus being effective to space saving and having multiple functions and fast copy speeds so as to meet the tendencies. Under such circumstances, increase in copy speed, reduction in size, and provision of multiple functions have to be sought from the design aspect.

However, the increase in copy speed, the reduction in size, and the provision of functions of the electrophotographic apparatus lead to reduction in size of the charging unit and increase in the process speed, so as to shorten a passing time of the photosensitive member in the charging unit, which makes it difficult to establish a high charge on the surface of the photosensitive member. From the aspect of energy saving, it is also necessary to lower power consumption of the entire electrophotographic apparatus by cutting the power to the drum heater and decreasing the value of electric current to the charging unit.

Particularly, with increase in the copy speed or with decrease in the diameter of the photosensitive member, there arises a significant problem about charging. In the case of the increase in the copy speed, even if the width of the charging unit is constant, the passing time of the photosensitive member in the charging unit becomes shorter, so as to result in degradation of chargeability. In the case of the decrease in the diameter, the width of the charging unit is limited, so as to fail to gain a sufficient charge.

A common problem to the increase of the speed and the decrease of the diameter of the photosensitive member is decrease of the time from exposure to the charging unit. In use of amorphous silicon, there arises a problem of optical memory due to exposure. This optical memory decreases with a lapse of time after exposure. Thus, the shorter this time, the easier a ghost appears in the image. In order to eliminate this optical memory called a ghost, it is possible to apply an excess amount of decharging (or charge-eliminating) exposure. However, degradation of chargeability resulted with increase in the amount of decharging exposure.

Japanese Patent Application Laid-Open No. 60-16187 discloses the technology for preventing the ghost by exposure with a decharging light of 600–800 nm, using a laser of near infrared exposure. Japanese Patent Application Laid-Open No. 58-102970 discloses the technology of preventing deterioration and improving the mechanical and chemical durability, using the wavelengths of 600 to 700 nm for the laser exposure.

There was, however, no publication disclosing a method of totally improving the chargeability, the ghost, the potential unevenness, etc. and thus the foregoing problems had to be solved for application to high-speed digital machines and digital machines with the compact photosensitive member of a-Si.

For designing the image forming apparatus and the electrophotographic image forming method, therefore, it is necessary to implement the improvement from the total viewpoint in the electrophotographic characteristics, the mechanical durability, etc. of the photosensitive member for image forming apparatus and accomplish further improvement in the charging apparatus with high charging efficiency and even charging and in the image forming apparatus, so as to solve the foregoing problems.

SUMMARY OF THE INVENTION

It is, therefore, an object of the present invention to provide an electrophotographic method and an electrophotographic apparatus that solve the prior art problems to the chargeability, the ghost, the potential unevenness, etc. and is suitable for application to high-speed digital machines and digital machines with the compact photosensitive member of a-Si.

It is another object of the present invention to provide an electrophotographic method and an electrophotographic apparatus that totally improve the electrophotographic characteristics, the mechanical durability, etc. of the photosensitive member for image forming apparatus and accomplish further improvement in the charging apparatus with high charging efficiency and uniform (or even) charging and in the image forming apparatus, so as to solve the foregoing problems.

According to a first aspect of the present invention, there is provided an electrophotographic method comprising forming a toner image at least through decharging of a photosensitive member as a recording element, charging, exposing, developing, and transferring, wherein at least a light-receiving layer of the photosensitive member is comprised of an amorphous material; a latent image is formed by the exposing with a light; the light has such a peak wavelength in an emission spectrum as to make minimum a value of optical memory at a unit contrast potential; and the decharging is implemented by use of a light having a full width at half maximum of a peak in an emission spectrum of not more than 50 nm.

According to a second aspect of the present invention, there is provided an electrophotographic method comprising forming a toner image at least through decharging of a photosensitive member as a recording element, charging, exposing, developing, and transferring, wherein at least a light-receiving layer of the photosensitive member is comprised of an amorphous material; a latent image is formed by the exposing with a light; and the light has such a peak wavelength in an emission spectrum as to make minimum a value of optical memory at a unit contrast potential and has a full width at half maximum of a peak in the emission spectrum of not more than 50 nm.

According to a third aspect of the present invention, there is provided an electrophotographic method comprising forming a toner image at least through decharging of a photosensitive member as a recording element, charging, exposing, developing, and transferring, wherein at least a light-receiving layer of the photosensitive member is comprised of an amorphous material; a latent image is formed by the exposing with a light; the light has such a peak wavelength in an emission spectrum as to make minimum a value of optical memory at a unit contrast potential and has a full width at half maximum of a peak in an emission spectrum of not more than 50 nm; and the decharging is implemented by use of a light having a full width at half maximum of a peak in an emission spectrum of not more than 50 nm.

According to a fourth aspect of the present invention, there is provided an electrophotographic apparatus for forming a toner image at least through decharging of a photosensitive member as a recording element, charging, exposing, developing, and transferring, wherein at least a light-receiving layer of the photosensitive member is comprised of an amorphous material; an exposure for forming a latent image is implemented by use of a light having such a peak wavelength in an emission spectrum as to make minimum a value of optical memory at a unit contrast potential; and the decharging is implemented by use of a light having a full width at half maximum of a peak in an emission spectrum of not more than 50 nm.

According to a fifth aspect of the present invention, there is provided an electrophotographic apparatus for forming a toner image at least through decharging of a photosensitive member as a recording element, charging, exposing, developing, and transferring, wherein at least a light-receiving layer of the photosensitive member is comprised of an amorphous material, and an exposure for forming a latent image is implemented by use of a light having such a peak wavelength in an emission spectrum as to make minimum a value of optical memory at a unit contrast potential and having a full width at half maximum of a peak in an emission spectrum of not more than 50 nm.

According to a sixth aspect of the present invention, there is provided an electrophotographic apparatus for forming a toner image at least through decharging of a photosensitive member as a recording element, charging, exposing, developing, and transferring, wherein at least a light-receiving layer of the photosensitive member is comprised of an amorphous material; an exposure for forming a latent image is implemented by use of a light having such a peak wavelength in an emission spectrum as to make minimum a value of optical memory at a unit contrast potential and having a full width at half maximum of a peak in an emission spectrum of not more than 50 nm; and the decharging is implemented by use of a light having a full width at half maximum of a peak in an emission spectrum of not more than 50 nm.

DETAILED DESCRIPTION OF THE PREFERRED EMBODIMENTS

In order to solve the aforementioned problems, the present inventors have conducted extensive and intensive research and found that the use of the light with the wavelength and the FWHM of a peak in an emission spectrum according to the present invention for the image exposure and decharging light leads to improvement in the ghost and potential unevenness even under the severe conditions of chargeability, such as the increase in speed and the decrease in the diameter of the photosensitive member, so as to gain a sufficient charge potential without need for radiation of excess decharging light, thereby accomplishing the present invention.

In the present invention, the image exposure is implemented with such light that the optical memory at a unit contrast potential is minimum under the condition that a difference (contrast potential) between a dark potential and a light potential is constant. This made improvement feasible in the chargeability and the ghost memory. Further, the FWHM of a peak of an emission spectrum of the decharging light is set not more than 50 nm, which led to improvement in the potential unevenness.

The present invention will be described hereinafter in further detail.

Figure 2:
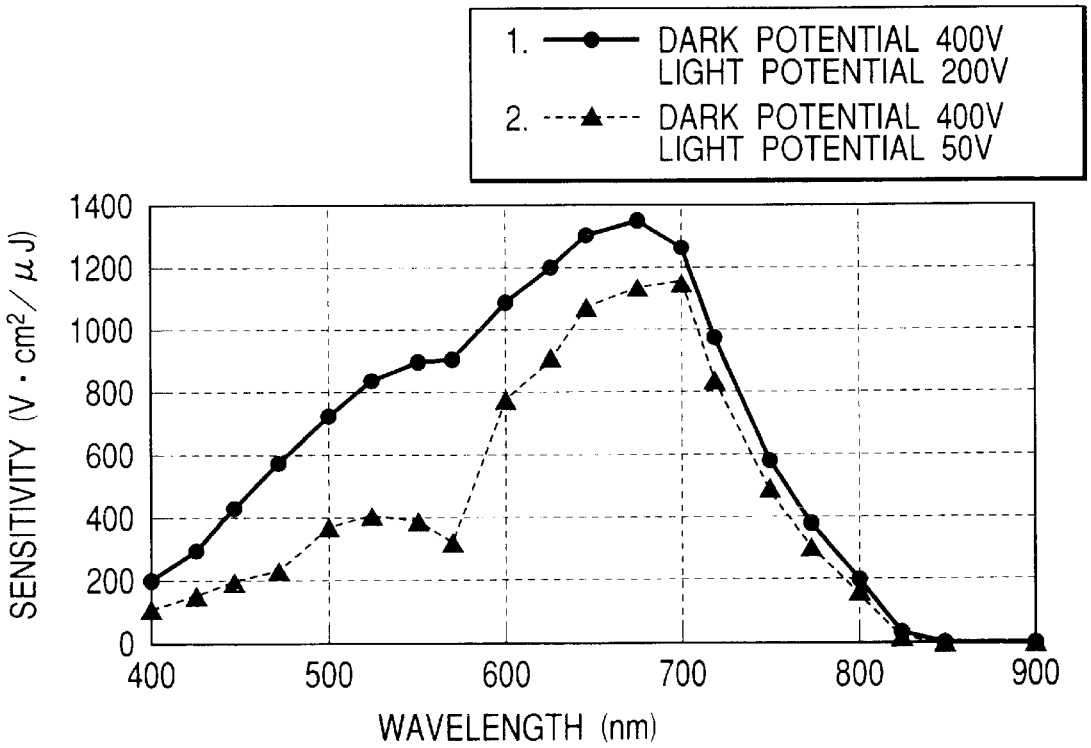
FIG. 2 is a graphical representation as a plot of sensitivity against wavelength of the a-Si photosensitive member, in which the sensitivity indicates values measured under respective setting conditions: dark potential 400 V and light potential (or lighted potential or bright potential) 200 V; dark potential 400 V and light potential 50 V.

FIG. 2 shows the sensitivity at each wavelength of the a-Si photosensitive member. The sensitivity is indicated as values of surface potential decrease at a fixed light quantity. The a-Si photosensitive member has a sensitivity peak near 700 nm and it is considered that the sensitivity suddenly decreases at wavelengths over 700 nm, because sufficient energy over the band gap cannot be imparted.

However, only use of the high-sensitivity wavelength for the image exposure light source was not sufficient for use of the a-Si photosensitive member. This is because a-Si gives rise to optical memory due to exposure and only the use of the best-sensitivity wavelength as the wavelength of the image exposure was not enough to achieve the effect of satisfactory improvement in the ghost.

Figure 3A:
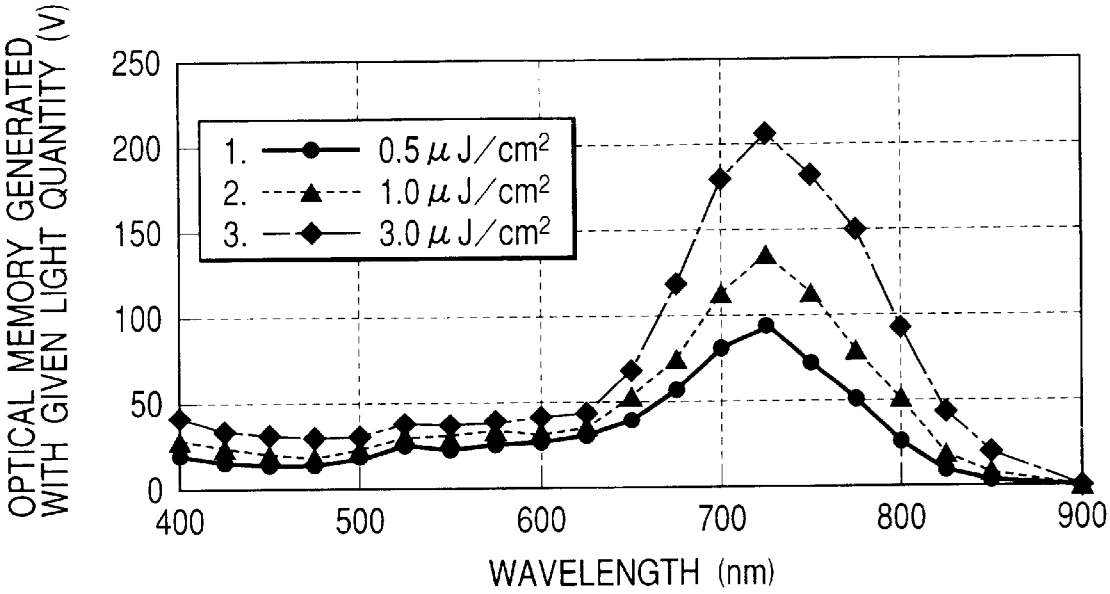
FIG. 3A is a graphical representation in which values of optical memory appearing at a given light quantity on the a-Si photosensitive member are plotted against wavelength, which shows a plot with change in quantity of exposure light.
Figure 3B:
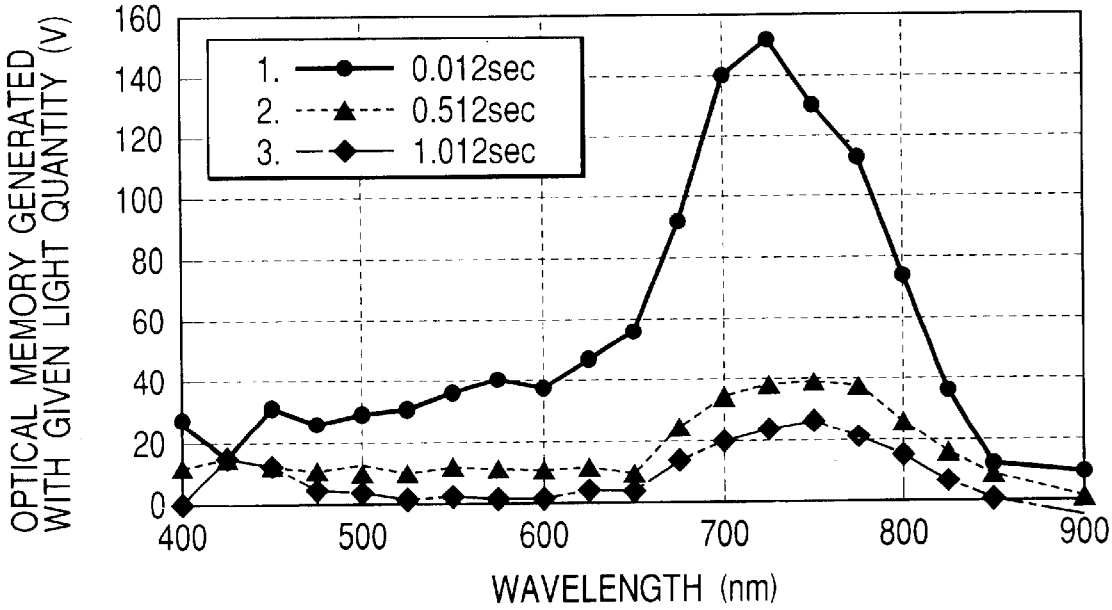
FIG. 3B is a graphical representation in which values of optical memory appearing at a given light quantity on the a-Si photosensitive member are plotted against wavelength, which shows a plot with change in the time (unit: sec) from exposure to charging.

Thus, the inventors have conducted research and succeeded in evaluating how much the irradiation light before charging is involved in the optical memory, in numerical form at each wavelength. FIG. 3A shows decreases of generated charge potentials under irradiation at fixed light quantities. These potential decreases will be called optical memory below. FIG. 3B shows the results of measurement of the optical memory against change of the time from irradiation to charging. As the time from exposure to charging increased, the optical memory decreased, but there was little change in the peak wavelength of the optical memory. It was seen from these results that the wavelengths responsible for the decrease of chargeability were those of the light near 730 nm. The unit of the time in FIG. 3B is second.

Figure 1:
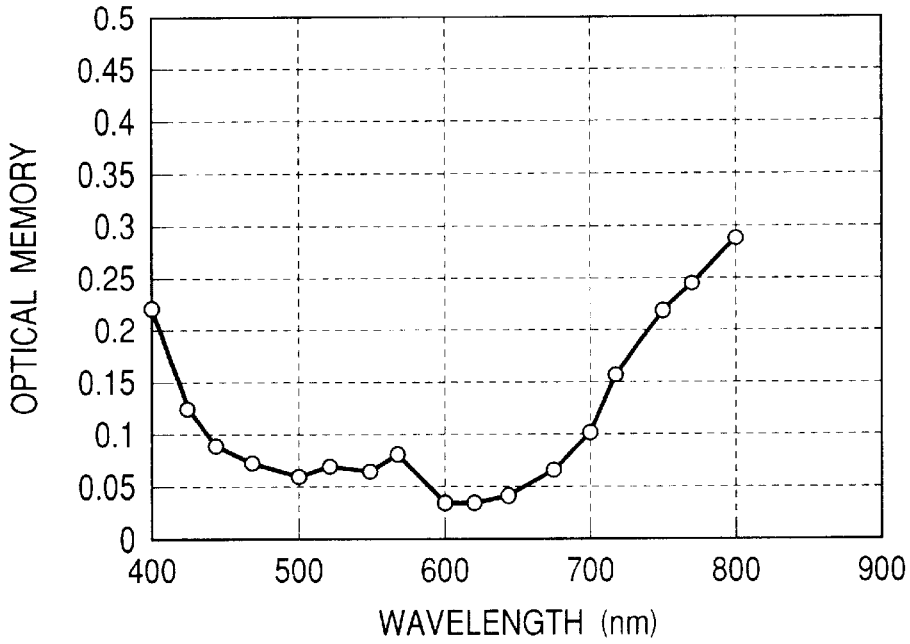
FIG. 1 is a graphical representation in which the optical memory at a unit contrast potential on the a-Si photosensitive member is plotted against wavelength, which is used for determining a suitable value of the wavelength for image exposure in the present invention.

FIG. 1 was obtained from the above-stated two experiments. FIG. 1 was calculated by dividing the values of optical memory at respective wavelengths in curve 2 of FIG. 3A by the values of sensitivity at corresponding wavelengths in curve 2 of FIG. 2. FIG. 1 shows the results of calculation at the respective wavelengths of the optical memory at a unit contrast potential of the photosensitive member used in Experiment 1. It is seen from the above results that in order to decrease the memory of the ghost or the like while maintaining the sensitivity, it is necessary to decrease the ratio of optical memory to sensitivity of the photosensitive member. Namely, it was found that the ghost potential was able to be decreased by use of such an image exposure light as to make minimum the optical memory appearing at a unit contrast potential.

It was also found that the rank of the ghost memory on the image became higher by use of the image exposure wavelength in the range of 500 nm to 680 nm. The effective range was more preferably 600 nm to 660 nm. Thus, the use of the image exposure light source to minimize the ratio of optical memory before charging relative to sensitivity is effective in achieving high chargeability of a-Si even under the severe conditions of chargeability, such as the increase of the speed and the decrease of the diameter of the a-Si photosensitive member.

The following conceivably accounts for this effect. The optical memory increases as the wavelength of the image exposure light becomes higher than 660 nm. On the other hand, when the light source is one like an LED or a semiconductor laser having the wavelength smaller than 600 nm, a residual potential becomes large and causes degradation of apparent sensitivity, so as to result in irradiation of excess light, thereby increasing the optical memory.

In the case of the semiconductor lasers being used, use of these wavelengths enables dot sizes to be decreased in the optical design level, which makes it feasible to obtain images with high quality.

Described below is the optimal decharging exposure in the case of use of the above image exposure according to the present invention. When the wavelength of the decharging light is larger than 680 nm, the potential unevenness tends to increase abruptly. This is possibly because with unevenness of film quality it becomes easier for the decharging light to give rise to unevenness of optical memory. The reason why unevenness becomes larger with decrease in the wavelength on the short wavelength side is occurrence of residual potential unevenness. It was verified that, for relieving the unevenness, the decharging light had the wavelength preferably in the range of not less than 600 nm nor more than 680 nm and more preferably in the range of not less than 630 nm nor more than 680 nm.

Figure 17:
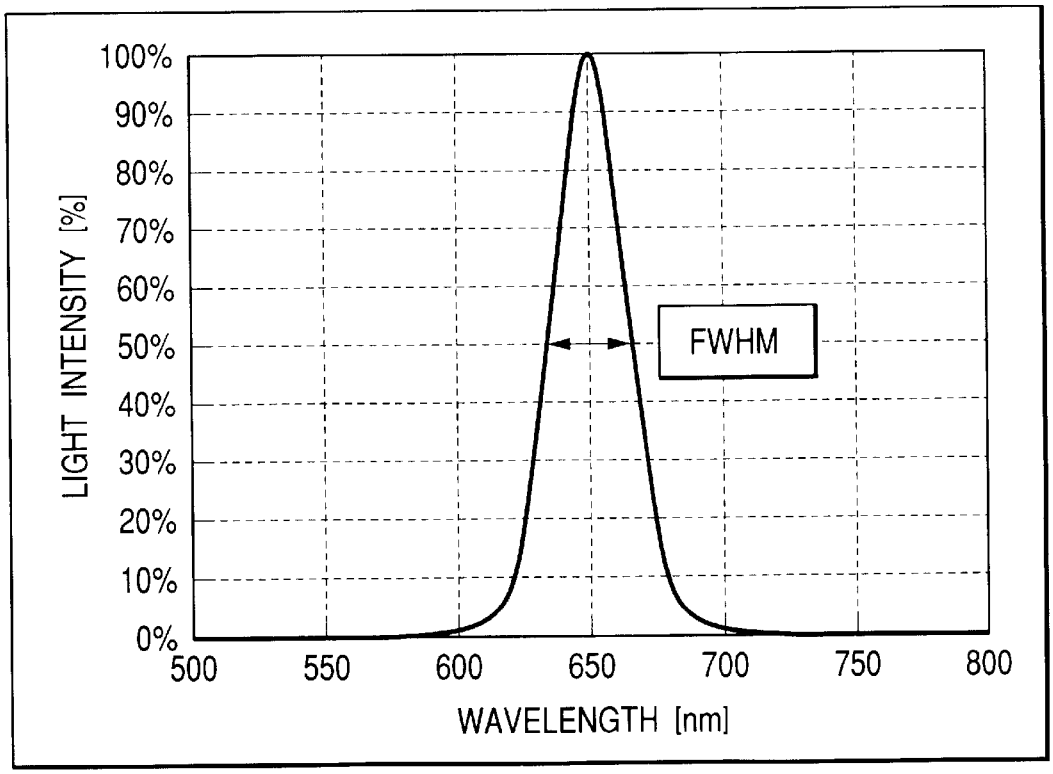
FIG. 17 is a view showing the FWHM of a peak in an emission spectrum referred to in the present invention.

Further, the inventors have eagerly conducted research on correlation between FWHM (Full Width at Half Maximum) of a peak in an emission spectrum of the decharging light and image exposure light and potential unevenness and have found therefrom that the potential unevenness is dependent on their FWHM, the potential unevenness is improved by narrowing the peak half wavelength, and the potential unevenness is improved to a considerably good level even in use of the LED having the peak wavelength of 700 nm when the FWHM is not more than 50 nm. A conceivable reason for this is that the narrowing of the FWHM uniformizes a light absorbing region in the direction of the depth of the photosensitive member and this uniformizes on an apparent basis the factors of unevenness such as the optical memory unevenness and the residual potential unevenness. The term "FWHM" used herein is a full wavelength width at half maximum of optical intensity in a spectral distribution of the light source as shown in FIG. 17.

We obtained the result that the improvement in the potential unevenness owing to the narrowing of the FWHM of a peak in an emission spectrum was dependent upon the travel speed of the surface of the photosensitive member.

Namely, the particularly prominent effect was recognized when the travel speed was 200–600 mm/sec. This is conceivably for the following reason. In the case of the decharging light as an example, it is considered that when the travel speed is smaller than 200 mm/sec, the time from the decharging exposure process to the charging process becomes long enough to relax the unevenness factors due to the decharging process, such as the optical memory or the like, and relieve the potential unevenness regardless of the FWHM of a peak in an emission spectrum of the decharging light. It is also considered that when the travel speed becomes higher than 600 mm/sec, the passing time through the charger process becomes shorter and thus unevenness caused by the charging process becomes more dominant than the unevenness due to the decharging light.

The ghost potential was evaluated against chargeability and it was found therefrom that to satisfy the above range was effective to improvement in the ghost memory.

As described above, it was verified that the image exposure and the decharging exposure had to be used in the ranges of the present invention in order to satisfy all the three points of chargeability, ghost, and charging potential unevenness.

Figure 4A:
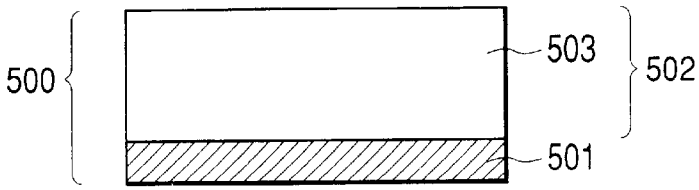
FIGS. 4A, 4B, 4C and 4D are schematic structure views for explaining layer configurations of photosensitive members for image forming apparatus according to the present invention.
Figure 4B:
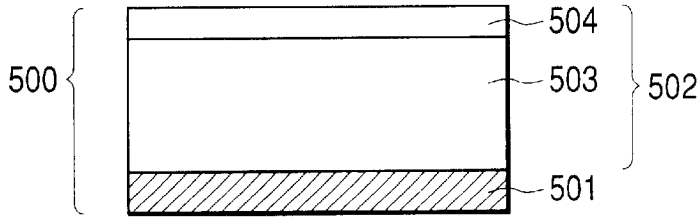
Figure 4C:
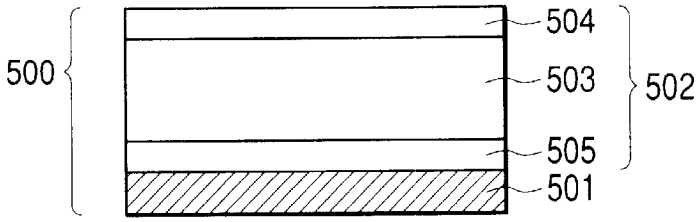

The photoconductive members according to the present invention will be described below in detail with reference to the drawings. FIGS. 4A to 4D are schematic structure views for explaining layer configurations of the photosensitive members for image forming apparatus. In the photosensitive member 500 for image forming apparatus shown in FIG. 4A, a photosensitive layer 502 is provided on a support 501 for the photosensitive member. The photosensitive layer 502 is comprised of a photoconductive layer 503 made of a-Si containing hydrogen and/or halogen (which will be abbreviated below as a-Si:H,X) and possessing the photoconductive property. FIG. 4B is a schematic structure view for explaining another layer configuration of the photosensitive member for image forming apparatus. In the photosensitive member 500 for image forming apparatus shown in FIG. 4B, the photosensitive layer 502 is provided on the support 501 for the photosensitive member. The photosensitive layer 502 is comprised of the photoconductive layer 503 made of a-Si:H,X and possessing the photoconductive property, and an amorphous silicon based surface layer 504. FIG. 4C is a schematic structure view for explaining another layer configuration of the photosensitive member for image forming apparatus. In the photosensitive member 500 for image forming apparatus shown in FIG. 4C, the photosensitive layer 502 is provided on the support 501 for the photosensitive member. The photosensitive layer 502 is comprised of the photoconductive layer 503 made of a-Si:H,X and possessing the photoconductive property, the amorphous silicon based surface layer 504, and an amorphous silicon based charge injection blocking layer 505.

Figure 4D:
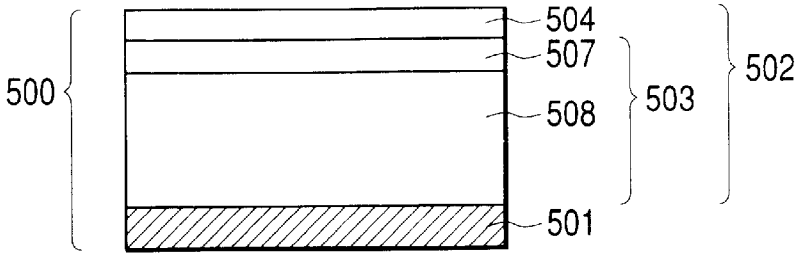

FIG. 4D is a schematic structure view for explaining still another layer configuration of the photosensitive member for image forming apparatus. In the photosensitive member 500 for image forming apparatus shown in FIG. 4D, the photosensitive layer 502 is provided on the support 501 for the photosensitive member. The photosensitive layer 502 is comprised of a charge generating layer 507 and a charge transport layer 508 of a-Si:H,X making the photoconductive layer 503, and the amorphous silicon based surface layer 504.

The effect of the present invention will be specifically described below with experiment examples. It is, however, noted that the present invention is by no means intended to be limited to these experiment examples.

Experiment 1

Using a system for fabricating the photosensitive member for image forming apparatus by the radio-frequency plasma CVD (RF-PCVD) method, the photosensitive member consisting of the charge injection blocking layer, the photoconductive layer, and the surface layer was made on a mirror-finished aluminum cylinder having the diameter of 108 mm, under the conditions presented in Table 1.

The optical memory at a unit contrast potential of this photosensitive member was calculated at each wavelength and the results of the calculation are presented in FIG. 1, as described previously.

Figure 18:
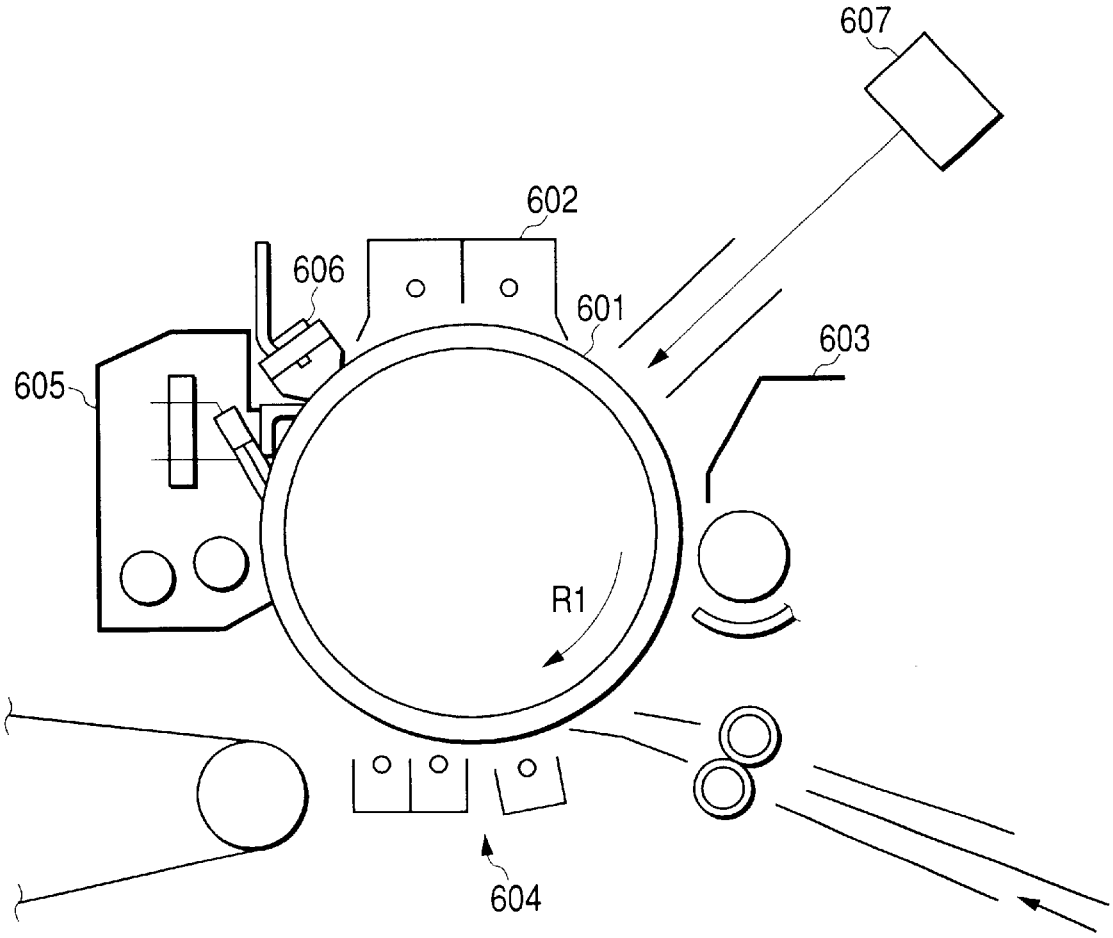
FIG. 18 is a schematic view for explaining the electrophotographic method and apparatus of the present invention.

The photosensitive member produced in this way was evaluated as set in the electrophotographic apparatus shown in FIG. 18. As shown in this figure, around the electrophotographic, photosensitive member 601 of a cylinder shape rotating in the direction R1, there are provided a main charging unit 602, a developing unit 603, a transfer-separation charging unit 604, a cleaning device 605, a main decharging light source 606, and an exposure device 607.

Figure 5:
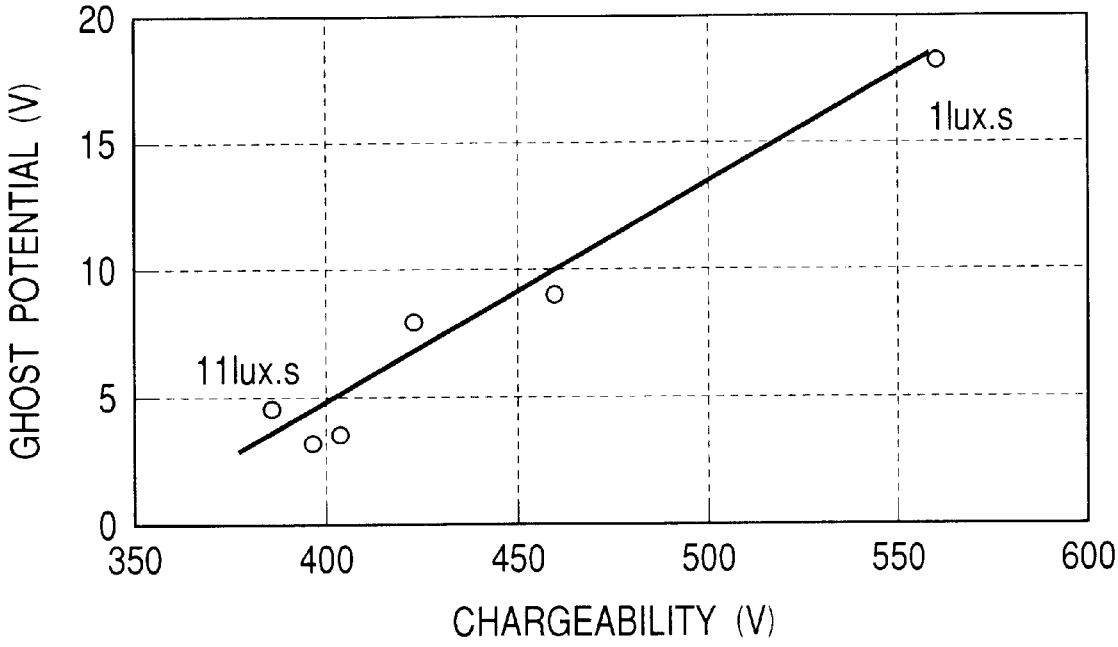
FIG. 5 is a graphical representation showing a relation between chargeability and ghost potentials measured under the setting conditions of the dark potential of 400 V and the light potential of 50 V with respective quantities of decharging light, as plotted using the quantity of decharging light as a parameter, in a configuration in which the decharging light is supplied from a 680 nm LED head and the image exposure light from a 700 nm LED head.

In the present invention the photosensitive member thus produced was set in the image forming apparatus (Canon NP6060 modified for digital tests) to evaluate ranks of the chargeability and ghost memory. Preexposure was implemented by use of a 680 nm LED and the image exposure by use of a 700 nm LED, and the photosensitive member was rotated at the speed of 300 mm/sec. The chargeability was evaluated as values measured when the electric current of the primary charger was 1000 $\mu$A. The ghost potentials were obtained as dark potentials measured after exposure was conducted under the setting of the dark potential of 400 V and the potential of 50 V at the exposed portions and the photosensitive member after the exposure was rotated by one turn. Under these conditions, the quantity of the decharging light was varied from 1 [lux.sec] to 11 [lux.sec], to obtain the chargeability and the ghost potential at each quantity of the decharging light. The results of this measurement are presented in FIG. 5. With increase in the quantity of the decharging light the potential appearing as a ghost decreased, but the chargeability also decreased.

Figure 6:
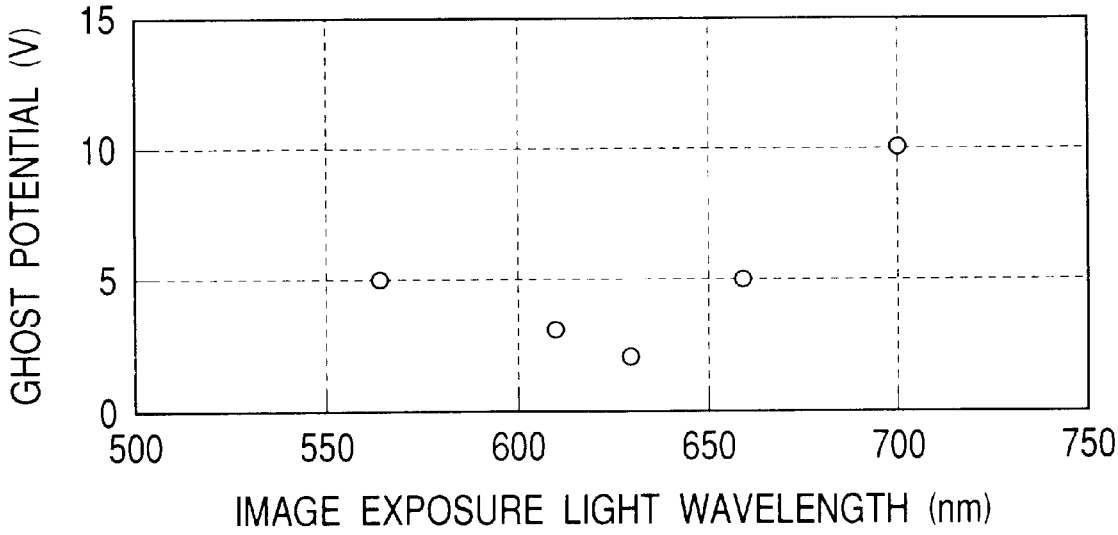
FIG. 6 is a graphical representation showing ghost potentials against respective image exposure wavelengths in a configuration in which the image exposure light source is an LED.

Then, the quantity of the decharging light was fixed at 4 lux.sec and the wavelength of the image exposure light was varied. LED heads of 565, 610, 630, 660, and 700 nm were used as the light sources for the image exposure and ghost potentials were measured. The results are presented in FIG. 6. As seen from FIG. 6, the ghost potentials are lower in use of the LEDs of 565, 610, 630, and 660 nm as the image exposure light source than in use of the LED head of 700 nm as the image exposure light source.

Experiment 2

The photosensitive member fabricated in the same manner as in Experiment 1 was used to evaluate ranks of the chargeability and ghost memory, using the same image forming apparatus as in Experiment 1.

Figure 7:
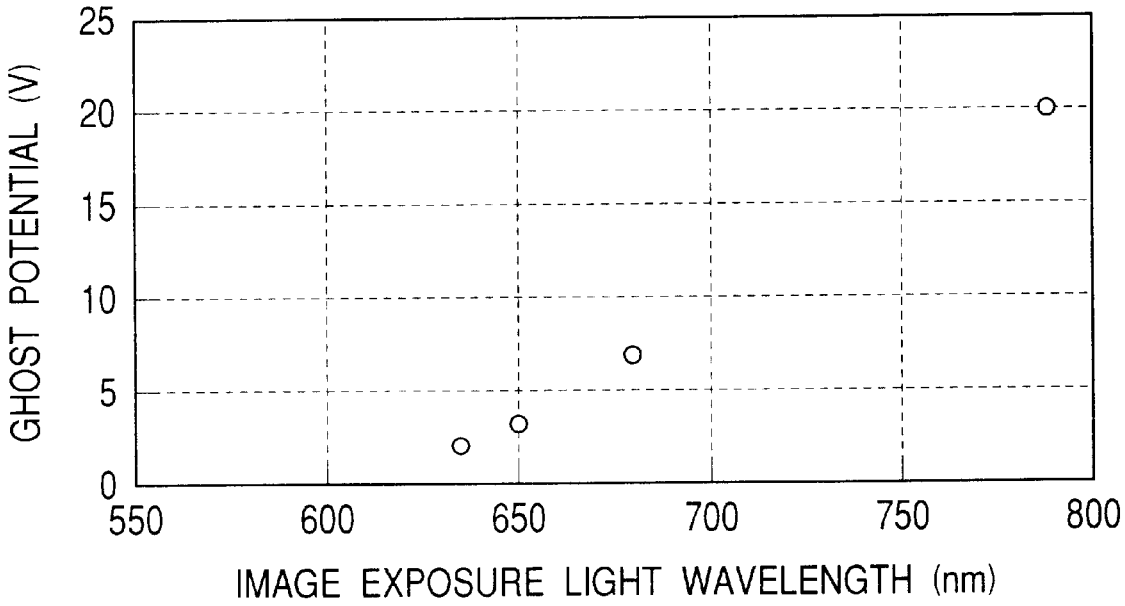
FIG. 7 is a graphical representation showing ghost potentials against respective image exposure wavelengths in a configuration in which the image exposure light source is a semiconductor laser.

Semiconductor lasers of 635, 650, 680, and 788 nm were used for the image exposure, an LED of 680 nm for the decharging light, and the quantity of light was 4 [lux.sec]. Under these conditions a ghost potential was measured at each image exposure wavelength and the results are presented in FIG. 7. As apparent from the figure, the ghost potentials are lower in use of the semiconductor lasers of 635 and 650 nm as the image exposure light source.

As seen from Experiments 1 and 2, it was found that the ghost memory was improved by use of such an image exposure light source that the value of optical memory before charging against sensitivity was minimum. As a consequence, it becomes feasible to decrease the quantity of the preexposure light and increase the chargeability, as compared with the conventional apparatus.

In Experiments 3 to 9 below the photosensitive member fabricated in the same manner as in Experiment 1 was evaluated using the same image forming apparatus as in Experiment 1. Each of the experiments will be described below.

Experiment 3

Research was conducted on correlation between potential unevenness at dark portions and peak wavelength of the decharging light. The potential unevenness was defined as follows; surface potentials were measured on the photosensitive member and the potential unevenness was defined as a difference between a maximum and a minimum in the measurement area. In the present experiment example, surface potentials were measured at five points along a direction of a generator of the photosensitive member, circumferential profiles at the respective points were added thereto, and the potential unevenness was determined as a difference between a maximum and a minimum of surface potentials on the entire surface of the photosensitive member.

Figure 8:
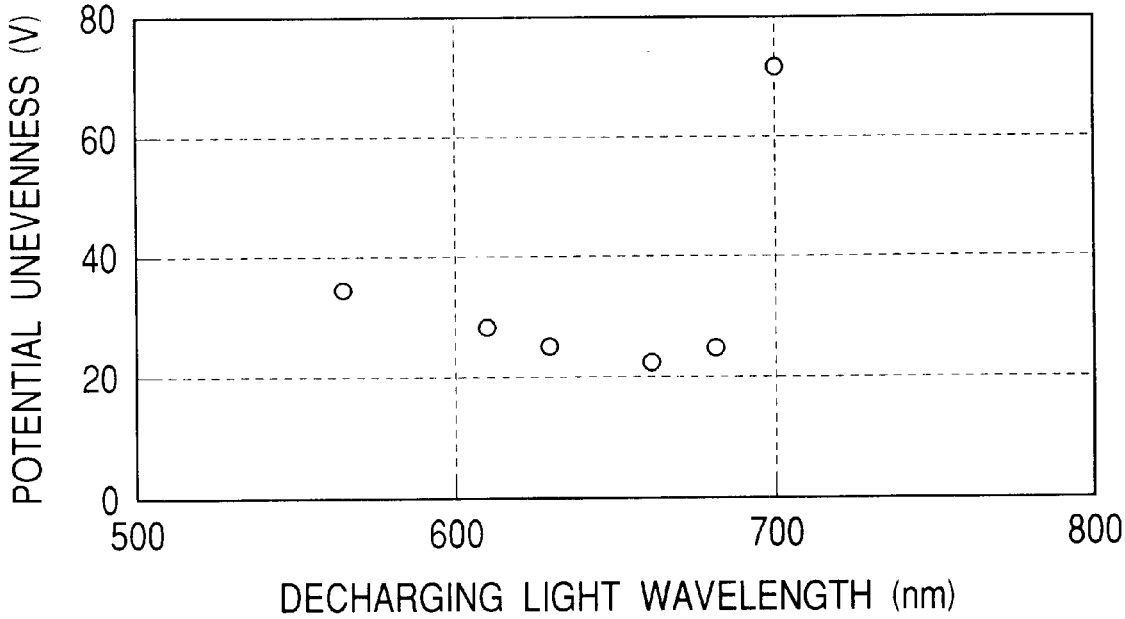
FIG. 8 is a graphical representation showing dark potential unevenness against wavelength of decharging light under the condition that the dark potential is set at 400 V.

FIG. 8 shows the dependence of potential unevenness on decharging light wavelength at the same charging potential of 400 V. As the decharging exposure wavelength increases over 680 nm, the potential unevenness tends to increase abruptly. As the wavelength becomes smaller than 680 nm, the potential unevenness increases gradually. It was verified from this research that the decharging exposure light preferably had the wavelength in the range of not less than 600 nm nor more than 680 nm and more preferably in the range of not less than 630 nm nor more than 680 nm.

Experiment 4

Figure 10:
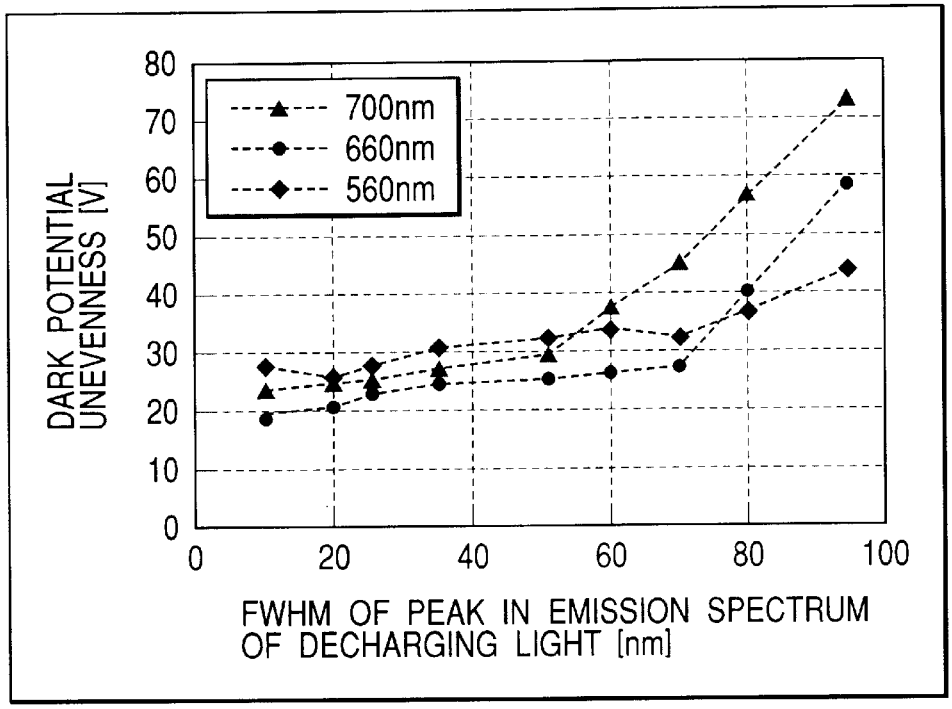
FIG. 10 is a graphical representation showing dark potential unevenness against FWHM (Full Width at Half Maximum) of a peak in an emission spectrum of decharging light under the setting of the dark potential of 400 V, where the FWHM of a peak in an emission spectrum is varied by a spectroscope and a slit.

Research was performed on correlation between the potential unevenness at dark portions and the FWHM of a peak in emission spectrum of the decharging light. Experiments were conducted by using a halogen lamp as a decharging light source and changing the wavelength and the FWHM by a spectroscope and a slit. FIG. 10 shows the potential unevenness at the same charging potential of 400 V, with respect to the peak wavelength of the decharging light as a parameter. As apparent from the figure, the potential unevenness is dependent on the FWHM and the potential unevenness also increases with increase of the FWHM. When the peak wavelength of the decharging light is 700 nm, the tendency appears most prominent and the potential unevenness increases abruptly as the FWHM increases over 50 nm. When the peak wavelength is either of 660 nm and 560 nm, the potential unevenness increases as the FWHM increases over 70 to 80 nm. It was found from these results that the good result as to the potential unevenness was achieved when the FWHM was not more than 50 nm, regardless of the peak wavelength.

Figure 11:
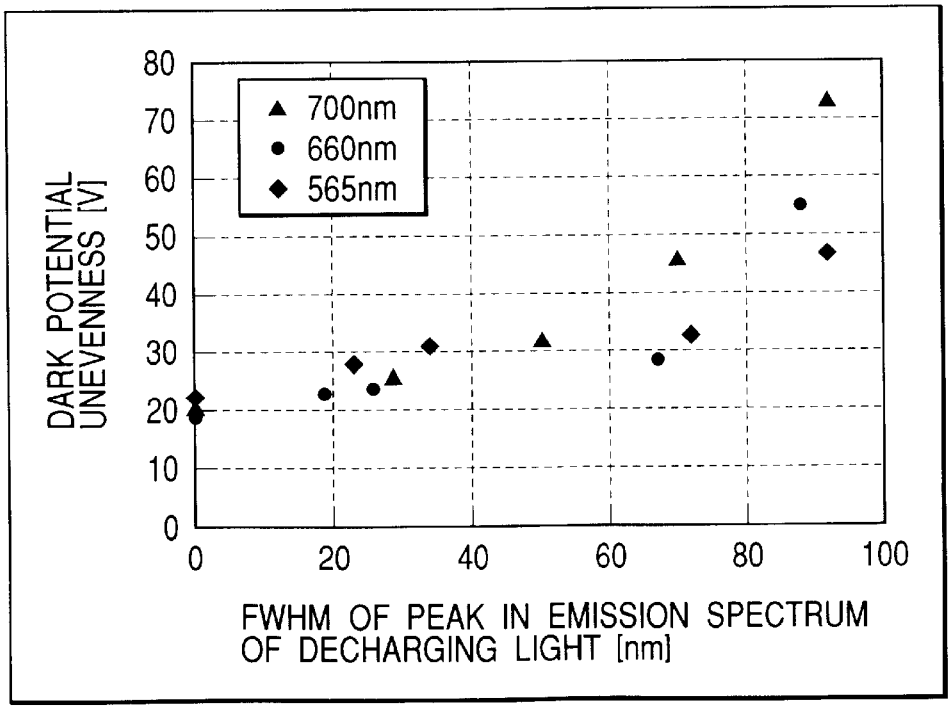
FIG. 11 is a graphical representation showing dark potential unevenness against FWHM of a peak in an emission spectrum of decharging light under the setting of the dark potential of 400 V with use of LEDs and lasers having different peak wavelengths and FWHMs.

Similar experiments were next conducted using LEDs equal in the peak wavelength of emission but different in the FWHM and lasers (FWHM of which are plotted as 0 nm). The results are presented in FIG. 11. As apparent from the figure, it was also found in this case that characteristics were similar to those in FIG. 10 and that the good result as to the potential unevenness was attained when the FWHM was not more than 50 nm.

Experiment 5

Figure 12:
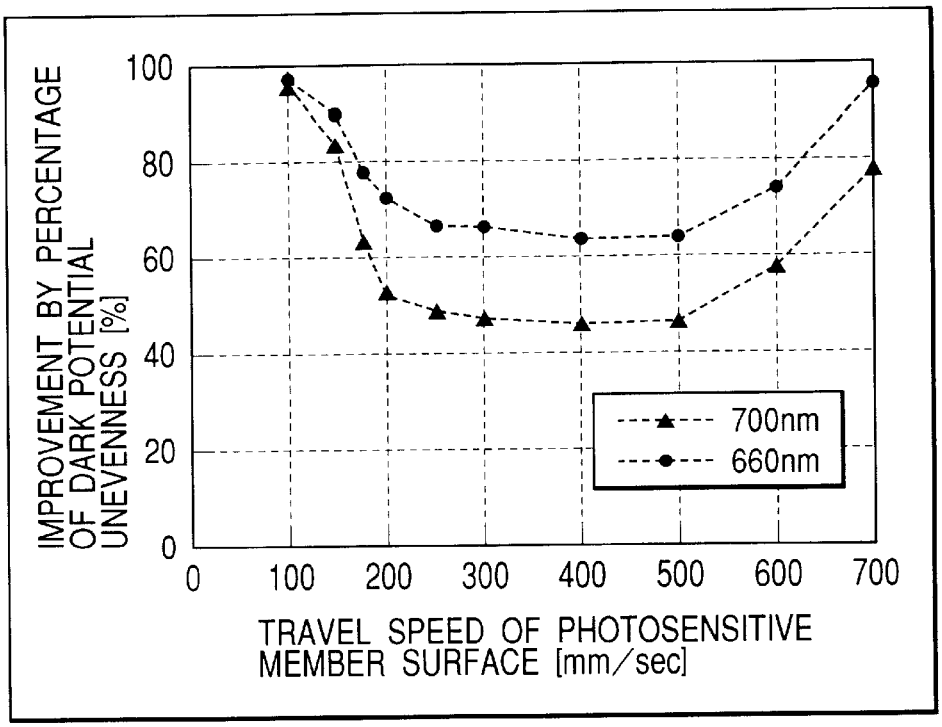
FIG. 12 is a graphical representation showing the dependence of improvement expressed in terms of percentage of dark potential unevenness (potential unevenness in use of the LED with the FWHM of a peak in an emission spectrum of 20 nm/potential unevenness in use of the LED with the FWHM of 90 nm) on the travel (or moving) speed of a photosensitive member surface.

The potential unevenness at dark portions was investigated with variation in the travel speed of the surface of the photosensitive member. The decharging light had the peak wavelength of 700 nm or 600 nm, and decharging was effected using LEDs equal in the peak wavelength but different in the FWHM. The improvement rate of potential unevenness was defined as a ratio of potential unevenness in use of the LED with the narrowest FWHM (FWHM: 20 nm) to potential unevenness in use of the LED with the widest FWHM (FWHM: 90 nm), and FIG. 12 shows a graph of a plot thereof against the travel speed of the surface of the photosensitive member. It is seen from this figure that effects of improvement in the potential unevenness owing to the narrowing of the FWHM of a peak in emission spectrum of the decharging light differ depending upon the travel speed of the surface of the photosensitive member. It was thus verified that the improvement effect in the potential unevenness became high, particularly, when the travel speed of the surface of the photosensitive member was in the range of 200 to 600 mm/sec.

Experiment 6

Figure 9:
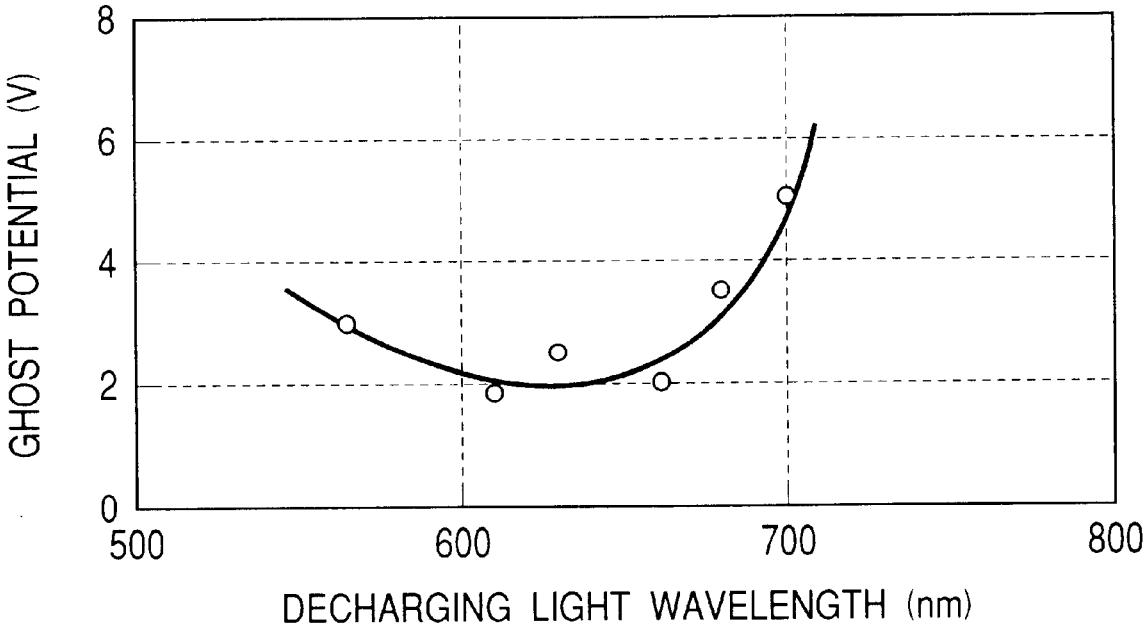
FIG. 9 is a graphical representation showing ghost potentials against respective wavelengths of decharging light in a configuration in which the image exposure light source is a semiconductor laser of 650 nm.

Influence of the decharging exposure on the ghost was evaluated. The primary current was fixed at 1000 $\mu$A and light quantities of the decharging light sources at respective wavelengths were controlled so that the chargeability became 400 V. A laser light source of 650 nm was used as an image exposure light source and was adjusted so that the potential became 50 V at exposed portions and the contrast potential 350 V. FIG. 9 shows ghost potentials against change in the wavelength of the decharging light in this case. It was verified that the ghost was improved when the decharging exposure was implemented with the decharging light having the wavelength in the range of not less than 600 nm nor more than 680 nm.

Experiment 7

Figure 13:
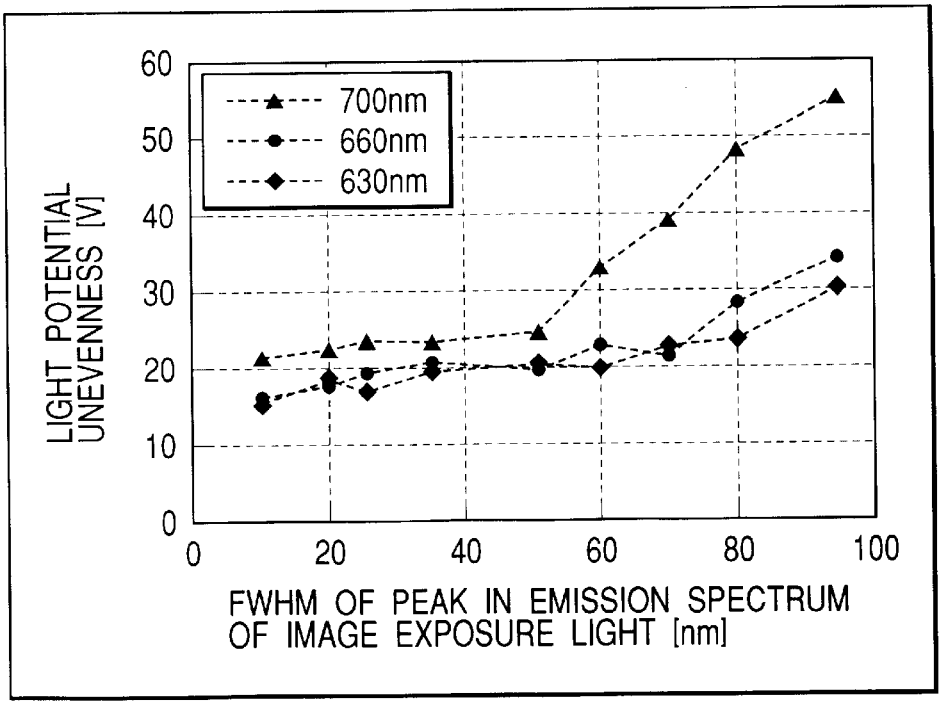
FIG. 13 is a graphical representation showing light potential unevenness against FWHM of a peak in an emission spectrum of image exposure light under the setting of the light potential of 50 V, where the FWHM is varied by the spectroscope and the slit.

Research was performed on correlation between the potential unevenness at bright portions and the FWHM of a peak in an emission spectrum of the image exposure light source. Experiments were conducted by using a halogen lamp as the image exposure light source and changing the wavelength and the FWHM by the spectroscope and the slit. An LED having the peak wavelength of 660 nm and the FWHM of 30 nm was used for the decharging light. FIG. 13 shows the potential unevenness at the same potential of 50 V controlled by charging and image exposure, with respect to the peak wavelength of the image exposure light as a parameter. As apparent from the figure, the potential unevenness is dependent on the FWHM and the potential unevenness also increases with increase of the FWHM. When the peak wavelength of the image exposure light is 700 nm, the tendency appears most prominent and the potential unevenness increases abruptly as the FWHM increases over 50 nm. When the peak wavelength is either of 660 nm and 630 nm, the potential unevenness increases as the FWHM increases over 70 to 80 nm. It was found from these results that the good result as to the potential unevenness was achieved when the FWHM was not more than 50 nm, regardless of the peak wavelength.

Figure 14:
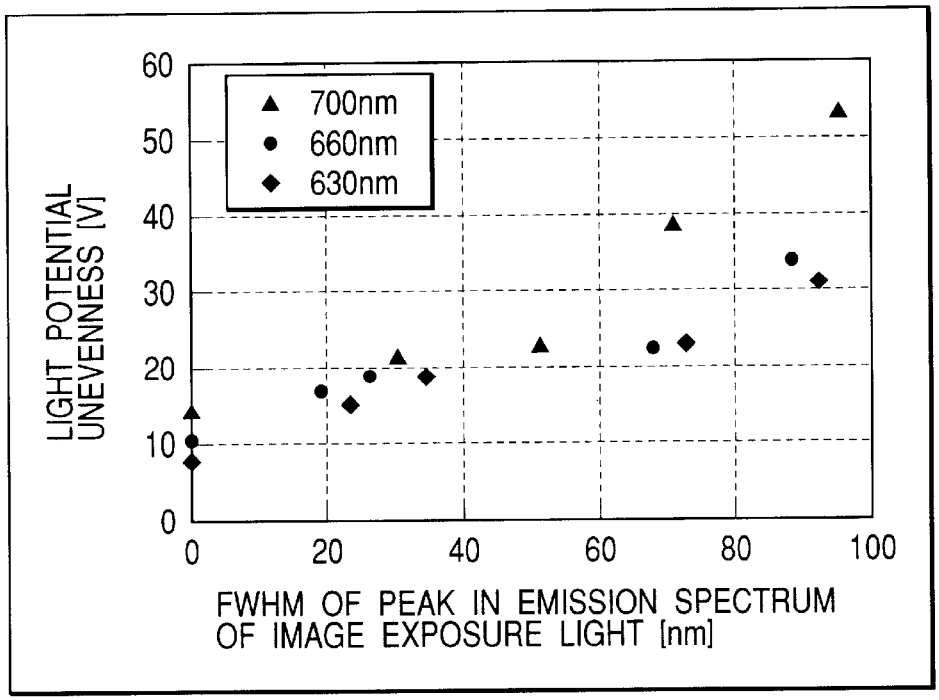
FIG. 14 is a graphical representation showing light potential unevenness against FWHM of a peak in an emission spectrum of image exposure light under the setting of the light potential of 50 V with use of LEDs and lasers having different peak wavelengths and FWHMs.

Similar experiments were next conducted using as the image exposure light source, LEDs equal in the peak wavelength of emission but different in the FWHM and lasers (FWHM of which are plotted as 0 nm). The results are presented in FIG. 14. As apparent from the figure, it was also found in this case that characteristics were similar to those in FIG. 13 and that the good result as to the potential unevenness was attained when the FWHM was not more than 50 nm.

Experiment 8

Figure 15:
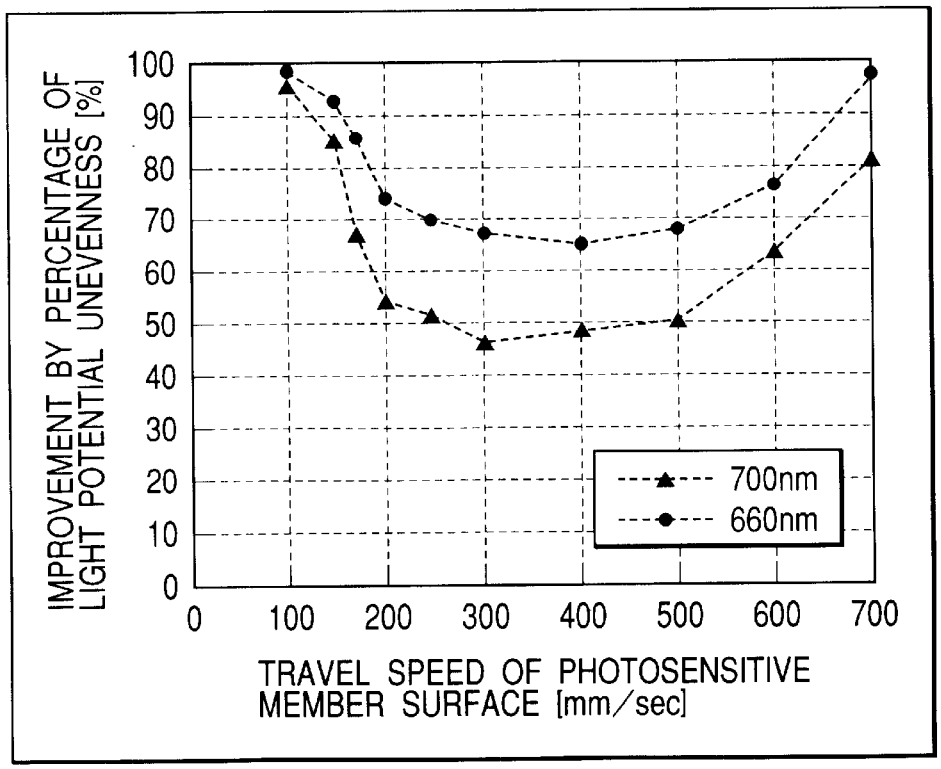
FIG. 15 is a graphical representation showing the dependence of improvement expressed in terms of percentage of light potential unevenness (potential unevenness in use of the LED with the FWHM of 20 nm/potential unevenness in use of the LED with the FWHM of 90 nm) on the travel speed of a photosensitive member surface.

The potential unevenness at bright portions was investigated with variation in the travel speed of the surface of the photosensitive member. The image exposure light had the peak wavelength of 700 nm or 600 nm, and the light source was either of LEDs equal in the peak wavelength but different in the FWHM. The decharging light was supplied from the light source of an LED having the peak wavelength of 660 nm and the FWHM of 30 nm. The improvement rate of potential unevenness was defined as a ratio of potential unevenness in use of the LED with the narrowest FWHM (FWHM: 20 nm) to potential unevenness in use of the LED with the widest FWHM (FWHM: 90 nm), and FIG. 15 shows a graph of a plot thereof against the travel speed of the surface of the photosensitive member. It is seen from this figure that effects of improvement in the potential unevenness owing to the narrowing of the FWHM of a peak in an emission spectrum of the image exposure light differ depending upon the travel speed of the surface of the photosensitive member. It was thus verified that the improvement effect in the potential unevenness became high, particularly, when the travel speed of the surface of the photosensitive member was in the range of 200 to 600 mm/sec.

Experiment 9

Figure 16:
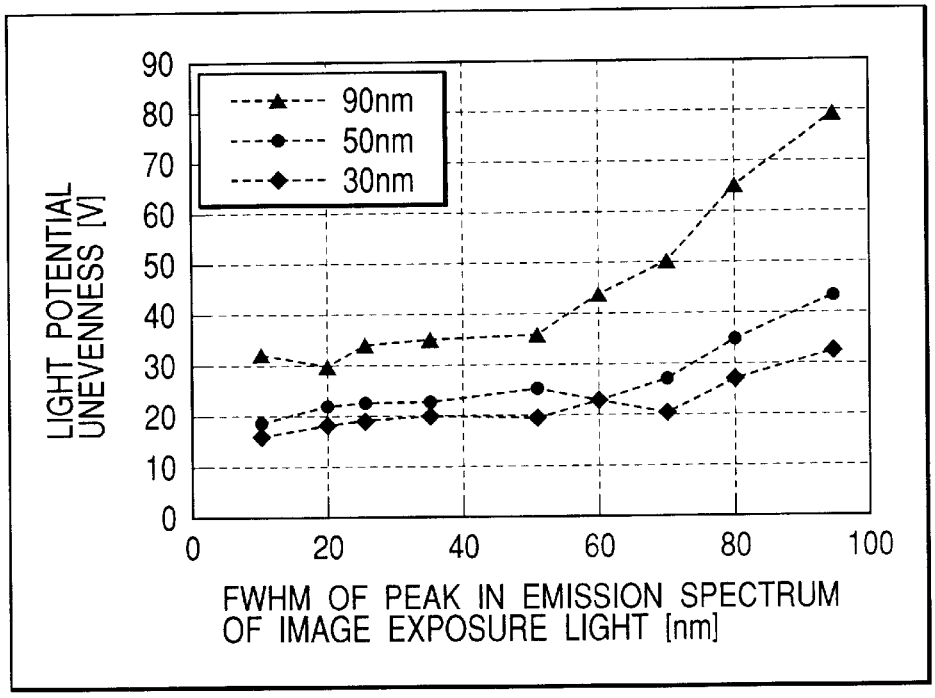
FIG. 16 is a graphical representation showing light potential unevenness against FWHM of a peak in an emission spectrum of image exposure light under the setting of the light potential of 50 V, as plotted using the FWHM of a peak in an emission spectrum of the decharging light as a parameter.

Investigation was conducted about correlation between the potential unevenness at bright portions and the FWHMs of the decharging light and the image exposure light. Experiments were carried out by using LEDs having respective peak wavelengths of 700 nm and 680 nm as the decharging light source and as the image exposure light source, respectively, and varying FWHMs of peak of emission spectrum of the respective light sources by use of the spectroscope and the slit. FIG. 16 shows the potential unevenness at the same potential of 50 V controlled by charging and image exposure, with respect to the FWHM of a peak in an emission spectrum of the decharging light as a parameter. As apparent from the figure, the light potential unevenness is dependent upon the FWHM of a peak in an emission spectrum of the image exposure light and the potential unevenness is improved in the FWHM of the image exposure light of not more than 50 nm, even in the largest unevenness case of the decharging light having the FWHM of 90 nm. Further, when the FWHM of a peak in an emission spectrum of the decharging light is either 50 nm or 30 nm, the potential unevenness is better than in the case of 90 nm, which also confirms the dependence on the FWHM of a peak in an emission spectrum of the decharging light. It was verified from the above results that the potential unevenness at bright portions was dependent on each of the FWHM of a peak in an emission spectrum of the decharging light and the FWHM of a peak in an emission spectrum of the image exposure light and that when either of the FWHMs was not more than 50 nm, the good result was obtained as to the potential unevenness. Further, it was also found that the result became much better, particularly, when the both FWHMs were not more than 50 nm.

EXAMPLE 1

The photosensitive member fabricated in the same manner as in Experiment 1 was subjected to image evaluation, using the image forming apparatus as employed in Experiment 1. The image exposure light source was the semiconductor laser having the wavelength of 635 nm, the decharging light source the semiconductor laser having the wavelength of 650 nm, and the photosensitive member was rotated at the speed of 200 mm/sec. At this time the chargeability effective to the formation of image was attained well. Then, evaluation was conducted for images formed under the setting of the dark potential of 400 V and the light potential of 50 V. Image originals were a solid white original, a solid black original (Canon test chart, part number FY9-9073), a halftone original (Canon test chart, part number FY9-9042), a ghost original (FY9-9042 laid on Canon test chart FY9-9040), and 0.5 mm graph paper. The results of the evaluation are presented in Table 2. In either case, good images were obtained. Particularly, the ghost images were extremely good with few ghosts recognized and with little density unevenness recognized.

EXAMPLE 2

The photosensitive member fabricated in the same manner as in Experiment 1 was subjected to the image evaluation, using the image forming apparatus as employed in Experiment 1. The image exposure light source was the semiconductor laser having the wavelength of 650 nm, the decharging light source the LED having the peak wavelength of 660 nm and the FWHM of 30 nm, and the photosensitive member was rotated at the speed of 250 mm/sec. At this time the chargeability effective to the formation of image was attained well. Then, the same evaluation as in Example 1 was carried out. The results of the evaluation are presented in Table 2. In either case, good images were obtained. Particularly, the ghost images were extremely good with few ghosts recognized and with little density unevenness recognized.

COMPARATIVE EXAMPLE 1

The photosensitive member fabricated in the same manner as in Experiment 1 was subjected to the image evaluation, using the image forming apparatus as employed in Experiment 1. The image exposure light source was the semiconductor laser having the wavelength of 788 nm, the decharging light source the LED having the peak wavelength of 660 nm and the FWHM of 30 nm, and the photosensitive member was rotated at the speed of 250 mm/sec. At this time the chargeability effective to the formation of image was attained well. Then, the same evaluation as in Example 1 was carried out. The results of the evaluation are presented in Table 2. However, ghosts were clearly recognized in the ghost images and no good image was obtained.

EXAMPLE 3

The photosensitive member fabricated in the same manner as in Experiment 1 was subjected to the image evaluation, using the image forming apparatus as employed in Experiment 1. The image exposure light source was the semiconductor laser having the wavelength of 650 nm, the decharging light source a halogen lamp which was spectroscopically modified to the peak wavelength of 680 nm and the FWHM of 40 nm by the spectroscope and the slit, and the photosensitive member was rotated at the speed of 350 mm/sec. At this time the chargeability effective to the formation of image was attained well. Then, the same evaluation as in Example 1 was carried out. The results of the evaluation are presented in Table 2. In either case, good images were obtained. Particularly, the ghost images were extremely good with few ghosts recognized and with little density unevenness recognized.

EXAMPLE 4

The photosensitive member fabricated in the same manner as in Experiment 1 was subjected to the image evaluation, using the image forming apparatus as employed in Experiment 1. The image exposure light source was the semiconductor laser having the wavelength of 650 nm, the decharging light source the LED having the peak wavelength of 680 nm and the FWHM of 90 nm, and the photosensitive member was rotated at the speed of 350 mm/sec. At this time the chargeability effective to the formation of image was attained well. Then, the same evaluation as in Example 1 was carried out. The results of the evaluation are presented in Table 2. In either case, images were obtained at a practically acceptable level. Particularly, the ghost images were extremely good with few ghosts recognized, though slight density unevenness was recognized therein.

EXAMPLE 5

The photosensitive member fabricated in the same manner as in Experiment 1 was subjected to the image evaluation, using the image forming apparatus as employed in Experiment 1. The image exposure light source was the LED head having the peak wavelength of 610 nm and the FWHM of 35 nm, the decharging light source the LED head having the peak wavelength of 610 nm and the FWHM of 35 nm, and the photosensitive member was rotated at the speed of 450 mm/sec. At this time the chargeability effective to the formation of image was attained well. Then, the same evaluation as in Example 1 was carried out. The results of the evaluation are presented in Table 2. In either case, good images were obtained. Particularly, the ghost images were extremely good with few ghosts recognized and with little density unevenness recognized.

EXAMPLE 6

The photosensitive member fabricated in the same manner as in Experiment 1 was subjected to the image evaluation, using the image forming apparatus as employed in Experiment 1. The image exposure light source was the halogen lamp which was spectroscopically modified to the peak wavelength of 680 nm and the FWHM of 40 nm by the spectroscope and the slit, the decharging light source the LED having the peak wavelength of 680 nm and the FWHM of 45 nm, and the photosensitive member was rotated at the speed of 360 mm/sec. At this time the chargeability effective to the formation of image was attained well. Then, the same evaluation as in Example 1 was carried out. The results of the evaluation are presented in Table 2. In either case, good images were obtained. Particularly, the ghost images were extremely good with few ghosts recognized and with little density unevenness recognized.

EXAMPLE 7

The photosensitive member fabricated in the same manner as in Experiment 1 was subjected to the image evaluation, using the image forming apparatus as employed in Experiment 1. The image exposure light source was the LED head having the peak wavelength of 680 nm and the FWHM of 90 nm, the decharging light source the LED head having the peak wavelength of 680 nm and the FWHM of 45 nm, and the photosensitive member was rotated at the speed of 360 mm/sec. At this time the chargeability effective to the formation of image was attained well. Then, the same evaluation as in Example 1 was carried out. The results of the evaluation are presented in Table 2. In either case, images were obtained at a practically acceptable level. Particularly, the ghost images were extremely good with few ghosts recognized, though slight density unevenness was recognized therein.

EXAMPLE 8

The photosensitive member fabricated in the same manner as in Experiment 1 was subjected to the image evaluation, using the image forming apparatus as employed in Experiment 1. The image exposure light source was the LED head having the peak wavelength of 610 nm and the FWHM of 35 nm, the decharging light source the semiconductor laser having the wavelength of 635 nm, and the photosensitive member was rotated at the speed of 550 mm/sec. At this time the chargeability effective to the formation of image was attained well. Then, the same evaluation as in Example 1 was carried out. The results of the evaluation are presented in Table 2. In either case, good images were obtained. Particularly, the ghost images were extremely good with few ghosts recognized and with little density unevenness recognized.

EXAMPLE 9

The photosensitive member fabricated in the same manner as in Experiment 1 was subjected to the image evaluation, using the image forming apparatus as employed in Experiment 1. The image exposure light source was the semiconductor laser having the wavelength of 650 nm, the decharging light source the LED having the peak wavelength of 660 nm and the FWHM of 30 nm, and the photosensitive member was rotated at the speed of 650 mm/sec. At this time the chargeability effective to the formation of image was attained well. Then, the same evaluation as in Example 1 was carried out. The results of the evaluation are presented in Table 2. In either case, images were obtained at a practically acceptable level. Particularly, the ghost images were good with few ghosts recognized, though slight density unevenness was recognized therein.

According to the present invention, it is feasible to provide the electrophotographic method and electrophotographic apparatus with high chargeability and with improvement in the ghost memory and the potential unevenness even under the conditions for higher speed and more compact structure.

Particularly, it is feasible to provide the electrophotographic process improved in the ghost memory and the potential unevenness and causing few phenomena of ghosts and density unevenness to appear on images.

When the image exposure light source is a semiconductor laser, it is feasible to decrease the spot size and implement formation of images with much higher quality.

TABLE 1

| | | Charge injection blocking layer | Photoconductive layer 1 | Photoconductive layer 2 | Surface layer |
|---|---|---|---|---|---|
| Gas species and flow rates | $SiH_4$ (ml/min (normal)) | 100 | 200 | 200 | 10 |
| | $H_2$ (ml/min (normal)) | 300 | 800 | 800 | |
| | $B_2H_6$ (ppm) (relative to $SiH_4$) | 2000 | 2 | 0.5 | |
| | NO (ml/min (normal)) | 50 | | | |
| | $CH_4$ (ml/min (normal)) | | | | 500 |
| Support temperature (° C.) | | 290 | 290 | 290 | 290 |
| Internal pressure (Pa) | | 66.7 | 66.7 | 66.7 | 66.7 |
| RF power (W) | | 500 | 800 | 400 | 300 |
| Film thickness (μm) | | 3 | 20 | 7 | 0.5 |

TABLE 2

| | Decharging light | | | Image exposure light | | | Travel | Image evaluation results | | | | | |
|---|---|---|---|---|---|---|---|---|---|---|---|---|---|
| | light source | wave-length | FWHM | light source | wave-length | FWHM | speed (mm/sec) | white image | black image | 50% | GST | graph paper | total |
| Example 1 | laser | 650 | ~0 | laser | 635 | ~0 | 200 | A | A | A | A | A | A |
| Example 2 | LED | 660 | 30 | laser | 650 | ~0 | 250 | A | A | A | A | A | A |
| Comparative Example 1 | LED | 660 | 30 | laser | 788 | ~0 | 250 | B | B | B | D | B | D |
| Example 3 | halogen + spectroscope | 680 | 40 | laser | 650 | ~0 | 350 | A | A | A | A | A | A |
| Example 4 | LED | 680 | 90 | laser | 650 | ~0 | 350 | B | A | C | A | A | C |
| Example 5 | LED | 610 | 35 | LED | 610 | 35 | 450 | A | A | A | A | A | A |
| Example 6 | LED | 680 | 45 | halogen + spectroscope | 680 | 40 | 360 | A | A | A | A | A | A |
| Example 7 | LED | 680 | 45 | LED | 680 | 90 | 360 | A | B | C | A | A | C |
| Example 8 | laser | 635 | ~0 | LED | 610 | 35 | 550 | A | A | A | A | A | A |
| Example 9 | LED | 660 | 30 | laser | 650 | ~0 | 650 | B | B | B | A | A | B |

*Evaluation ranks
A: very good
B: good
C: practically acceptable
D: poor

What is claimed is:

1. An electrophotographic method for forming a toner image, the method comprising:

decharging a photosensitive member as a recording element using laser light having a full width at half maximum of a peak in an emission spectrum of not more than 50 nm, wherein at least a light-receiving layer of the photosensitive member comprises an amorphous material;

charging the photosensitive member;

exposing the charged photosensitive member to light having a peak wavelength in an emission spectrum that minimizes an optical memory value at a unit contrast potential to form a latent image;

developing the latent image; and transferring the developed image onto an image receiving material; thereby forming a toner image.

2. The electrophotographic method according to claim 1, wherein a surface of the photosensitive member travels at a speed of not less than 200 mm/sec and not more than 600 mm/sec.

3. The electrophotographic method according to claim 1 or 2, wherein the laser light used to decharge the photosensitive member has a peak wavelength of not less than 600 nm and not more than 680 nm.

4. The electrophotographic method according to claim 1 or 2, wherein the light used to expose the charged photosensitive member to form the latent image has a peak wavelength of not less than 600 nm and not more than 660 nm.

5. The electrophotographic method according to claim 1 or 2, wherein the laser light used to decharge the photosensitive member has a peak wavelength of not less than 600 nm and not more than to 680 nm, and the light used to expose the charged photosensitive member has a peak wavelength of not less than 600 nm and not more than 660 nm.

6. The electrophotographic method according to claim 1, comprising providing the light used to expose the charged photosensitive member to form the latent image with a light source selected from the group consisting of lasers and LEDs.

7. The electrophotographic method according to claim 1, wherein the photosensitive member comprises amorphous silicon.

8. The electrophotographic method according to claim 1, comprising forming the latent image by exposing the charged photosensitive member with light having a full width at half maximum of a peak in an emission spectrum of not more than 50 nm.

9. An electrophotographic apparatus for forming a toner image by decharging a photosensitive member as a recording element using laser light, charging the photosensitive member, exposing the charged photosensitive member to light to form a latent image, developing the latent image, and transferring the developed image onto an image receiving material, wherein at least a light-receiving layer of the photosensitive member comprises an amorphous material, the apparatus comprising:

at least one light source configured to direct light to the charged photosensitive member to form a latent image, wherein the light has a peak wavelength in an emission spectrum that minimizes an optical memory value at a unit contrast potential; and at least one laser light source configured to direct laser light to the photosensitive member, thereby decharging the photosensitive member, wherein the laser light has a full width at half maximum of a peak in an emission spectrum of not more than 50 nm.

10. The electrophotographic apparatus according to claim 9, wherein the apparatus is configured to provide a travel speed to a surface of the photosensitive member of not less than 200 mm/sec and not more than 600 mm/sec.

11. The electrophotographic apparatus according to claim 9 or 10, wherein the laser light used for decharging the photosensitive member has a peak wavelength of not less than 600 nm and not more than 680 nm.

12. The electrophotographic apparatus according to claim 9 or 10, wherein the light used to form the latent image on the charged photosensitive member has a peak wavelength of not less than 600 nm and not more than 660 nm.

13. The electrophotographic apparatus according to claim 9 or 10, wherein the laser light for decharging the photosensitive member has a peak wavelength of not less than 600 nm and more than 680 nm, and the light used to form the latent image on the charged photosensitive member has a peak wavelength of not less than 600 nm and not more than 660 nm.

14. The electrophotographic apparatus according to claim 9, wherein the at least one light source configured to direct light to the charged photosensitive member to form a latent image is selected from the group consisting of lasers and LEDs.

15. The electrophotographic apparatus according to claim 9, wherein the photosensitive member comprises amorphous silicon.

16. The electrophotographic apparatus according to claim 9, wherein the light from the at least one light source configured to direct light to the charged photosensitive member to form a latent image has a full width at half maximum of a peak in an emission spectrum of not more than 50 nm.

* * * * *